US009259914B2

(12) United States Patent
Resentera et al.

(10) Patent No.: US 9,259,914 B2
(45) Date of Patent: Feb. 16, 2016

(54) SYSTEM AND METHOD FOR ADJUSTING AND MONITORING THE PRESSURES OF PRINTING ROLLERS IN A FLEXOGRAPHIC PRINTING MACHINE WITH CENTRAL DRUM

(75) Inventors: Massimo Resentera, Verona (IT); Mauro Cattaruzza, Malo (IT); Aldo Peretti, Roletto (IT); Luigi Artuffo, Cologno Mozese (IT); Paolo De Grandis, Ancona (IT); Davide Andrea Maria Filippi, Bovisio-Masciago (IT)

(73) Assignees: GRAFIKONTROL S.P.A., Milan (IT); UTECO CONVERTING S.P.A., Colognola Ai Colli (IT)

( * ) Notice: Subject to any disclaimer, the term of this patent is extended or adjusted under 35 U.S.C. 154(b) by 0 days.

(21) Appl. No.: 13/976,753

(22) PCT Filed: Dec. 13, 2011

(86) PCT No.: PCT/EP2011/072621

§ 371 (c)(1),
(2), (4) Date: Jun. 27, 2013

(87) PCT Pub. No.: WO2012/089496

PCT Pub. Date: Jul. 5, 2012

(65) Prior Publication Data

US 2013/0269560 A1 Oct. 17, 2013

(30) Foreign Application Priority Data

Dec. 27, 2010 (IT) ..... VR2010A0252

(51) Int. Cl.

| | |
|---|---|
| ***B41F 1/54*** | (2006.01) |
| ***B41F 33/00*** | (2006.01) |
| ***B41F 5/24*** | (2006.01) |

(52) U.S. Cl.
CPC ..... *B41F 33/0072* (2013.01); *B41F 5/24* (2013.01); *B41F 33/0036* (2013.01)

(58) Field of Classification Search
CPC ..... B41F 33/0072
USPC ..... 101/484
See application file for complete search history.

(56) References Cited

U.S. PATENT DOCUMENTS

| | | | |
|---|---|---|---|
| 4,665,796 | A | 5/1987 | Staisch |
| 4,667,596 | A | 5/1987 | Dotzel et al. |

(Continued)

FOREIGN PATENT DOCUMENTS

| | | |
|---|---|---|
| AR | 019142 AA | 12/2001 |
| CA | 2379013 | 9/2002 |

(Continued)

OTHER PUBLICATIONS

International Search Report and Written Opinion dated Jan. 13, 2012 issued in PCT/EP2011/072621.

*Primary Examiner* — Anthony Nguyen
(74) *Attorney, Agent, or Firm* — Scully Scott Murphy and Presser; Peter Bernstein

(57) ABSTRACT

A system for adjusting and monitoring the pressures of the printing rollers of a flexographic printing machine, which comprises at least one reader which is adapted to be placed at the printing rollers of the printing machine. The reader is adapted to detect the contrast of the print on the printing material wrapped around the central drum of the printing machine and is connected to a processing unit which is adapted to determine and control, as a function of the contrast detected by the reader, the position of the printing rollers with respect to the central drum in order to achieve the desired print.

10 Claims, 3 Drawing Sheets

(56) References Cited

U.S. PATENT DOCUMENTS

| | | | | |
|---|---|---|---|---|
| 5,712,921 | A * | 1/1998 | Zabele | 382/112 |
| 5,731,989 | A * | 3/1998 | Tenny et al. | 358/1.9 |
| 5,774,225 | A * | 6/1998 | Goldstein et al. | 356/402 |
| 6,634,297 | B2 * | 10/2003 | Poetter | B41F 5/24 101/181 |
| 8,438,976 | B2 * | 5/2013 | Levanon et al. | 101/484 |
| 2006/0219109 | A1 * | 10/2006 | Cadillach | 101/211 |
| 2007/0079717 | A1 * | 4/2007 | De Vries et al. | 101/484 |
| 2008/0141886 | A1 | 6/2008 | Whitelaw et al. | |
| 2008/0156210 | A1 * | 7/2008 | Loddenkotter | B41F 33/0081 101/248 |
| 2008/0216697 | A1 * | 9/2008 | Takenouchi et al. | 101/484 |
| 2008/0276816 | A1 * | 11/2008 | Dorenkamp et al. | 101/484 |
| 2009/0249971 | A1 * | 10/2009 | Benvenuti et al. | 101/153 |
| 2009/0301330 | A1 * | 12/2009 | Noy | 101/484 |

FOREIGN PATENT DOCUMENTS

| | | | |
|---|---|---|---|
| EP | 1 249 346 | A1 | 10/2002 |
| EP | 1 666 252 | A2 | 6/2006 |
| ES | 2348297 | T3 | 12/2010 |
| WO | WO 2004/065127 | A2 | 8/2004 |
| WO | WO 2007/086052 | A2 | 8/2007 |

* cited by examiner

SYSTEM AND METHOD FOR ADJUSTING AND MONITORING THE PRESSURES OF PRINTING ROLLERS IN A FLEXOGRAPHIC PRINTING MACHINE WITH CENTRAL DRUM

TECHNICAL FIELD

The present invention relates to a system and a method for monitoring the pressures of the printing rollers in a flexographic printing machine. More particularly, the invention relates to a system and a method for monitoring the pressures of the printing rollers in a flexographic printing machine upon starting a new job.

BACKGROUND ART

As is known, flexographic printing machines with central drums have a plurality of printing plate rollers and anilox rollers arranged around a central drum; the printing plate rollers and anilox rollers transfer the ink onto the material to be printed depending on the printing pressures, i.e., depending on the pressure applied by each printing plate roller against the central drum and by each anilox roller against the respective printing plate. The pressure depends on the relative position of the printing plate with respect to the central drum and on the relative position of the anilox with respect to the printing plate.

Job changing, which occurs whenever the elements that cooperate to perform the printing process change, which elements in flexographic printing are the printing plate, the printing plate double adhesive, the printing plate sleeve, the anilox, the material to be printed and the inks, as well as the variation in the environmental conditions, such as temperature and humidity, always requires, for obtaining the desired print, the identification of the correct printing pressures, i.e., of the correct relative positions between the printing plate and the drum and between the anilox and the printing plate with respect to those calculated by the machine on the basis of the theoretical dimensions of the printing elements.

Identification of the correct pressures entails the production of product rejects and a waste of time and depends greatly on the skill and experience of the printer.

Today there are already automatic systems that aid or replace the printer in identifying and applying the correct printing pressures at the beginning of the printing process after job changing.

These systems can be divided substantially into two types: systems with print feedback; and offline systems without print feedback.

The former substantially measure printed markings (the markings are representative marks of the print) or the entire print with a video camera and then correct the printing pressures (see for example EP 1249346 and EP 1666252).

The latter, substantially before printing, measure the surface dimensions of the printing plate roller with systems which are external to the machine, store the measurement, then mount the printing plate roller on the machine and position it in contact with the central drum according to the stored data (see for example US 2008/0141886 A1).

However, these systems have some problems.

First of all, all systems with print feedback use a video camera that is capable of measuring and processing the entire printed image or more frequently specific markings that are representative of the printed image; the presence of these markings requires new printing plates and does not allow the use of old ones; moreover, each system uses different markings. The markings are located on the sides of the material and for an equal size of the printed image they require wider material and therefore a waste of material.

Furthermore, all "online" systems with print feedback control the movement of the printing plate rollers and of the anilox rollers so as to vary the printing pressures, wait for the print to be read by the video camera, measure the effect of the motion of the printing plate rollers and anilox rollers on the print and resume this process until the pressures are found to be correct; this operation takes a long time and produces considerable waste, which increases as the distance of the video cameras from the printing of the colors increases, as generally occurs due to space occupation problems.

All "online" systems with print feedback operate by comparing the print or the printed markings with a reference image that is representative of the print that one wishes to obtain in order to determine the correct printing pressures; the printer must therefore load this reference image into the system for example by means of a file.

All offline systems without print feedback measure only the dimensions of the printing plate rollers and anilox rollers when they are not mounted on the machine; they do not measure the other elements that are responsible inside the machine for the printing pressures, i.e., the printing material, the inks, the tolerances and the mechanical plays; these and the relationships among them change after a change of job and can change over time with an effect on printing pressures.

A further problem is that all offline systems without print feedback do not measure the print, are systems without feedback and therefore less precise and often require the intervention of the printer, who must retouch the printing pressures in order to obtain the desired print.

Last but not least, all these systems are complicated and expensive, produce a considerable waste of product, require time for setting up the new job for printing and almost always require the intervention of the printer, who has to retouch the printing pressures in order to obtain the desired print.

DISCLOSURE OF THE INVENTION

The aim of the present invention is to provide a system and a method for processing and monitoring printing pressures for a flexographic printing machine which solves the problems described above, i.e., a system and a method that measure directly the entire print and work with printing plates without markings and therefore do not require new printing plates.

Within this aim, an object of the invention is to provide a system and a method that measure the print without using a video camera.

Another object of the invention is to provide a system and a method that do not require the reference image for the printed image.

Another object of the invention is to provide a system and a method that make it possible to reduce the waste of product and the time required for automatic setup of the printing pressures after a change of job.

Another object of the invention is to provide a system and a method which are completely automatic and which, after completion of the method, do not require the intervention of the printer to retouch the printing pressures in order to obtain the desired print.

Another object of the present invention is to provide a system and a method which are simpler, more reliable and cheaper than currently used systems.

This aim, as well as these and other objects that will become more apparent hereinafter, are achieved by a system for adjusting and monitoring the pressures of printing rollers of a flexographic printing machine, characterized in that it comprises at least one reader which is adapted to be placed at the printing rollers of the printing machine, said reader being adapted to detect the contrast of the print on the printing material wrapped around the central drum of the printing machine, said reader being connected to a processing unit which is adapted to determine and control, as a function of the contrast detected by said reader, the position of the printing rollers with respect to said central drum in order to obtain the desired print.

BRIEF DESCRIPTION OF THE DRAWINGS

Further characteristics and advantages of the invention will become more apparent from the description of a preferred but not exclusive embodiment of the system and of the method according to the invention, illustrated by way of non-limiting example in the accompanying drawings, wherein.

WAYS OF CARRYING OUT THE INVENTION

Figure 1:
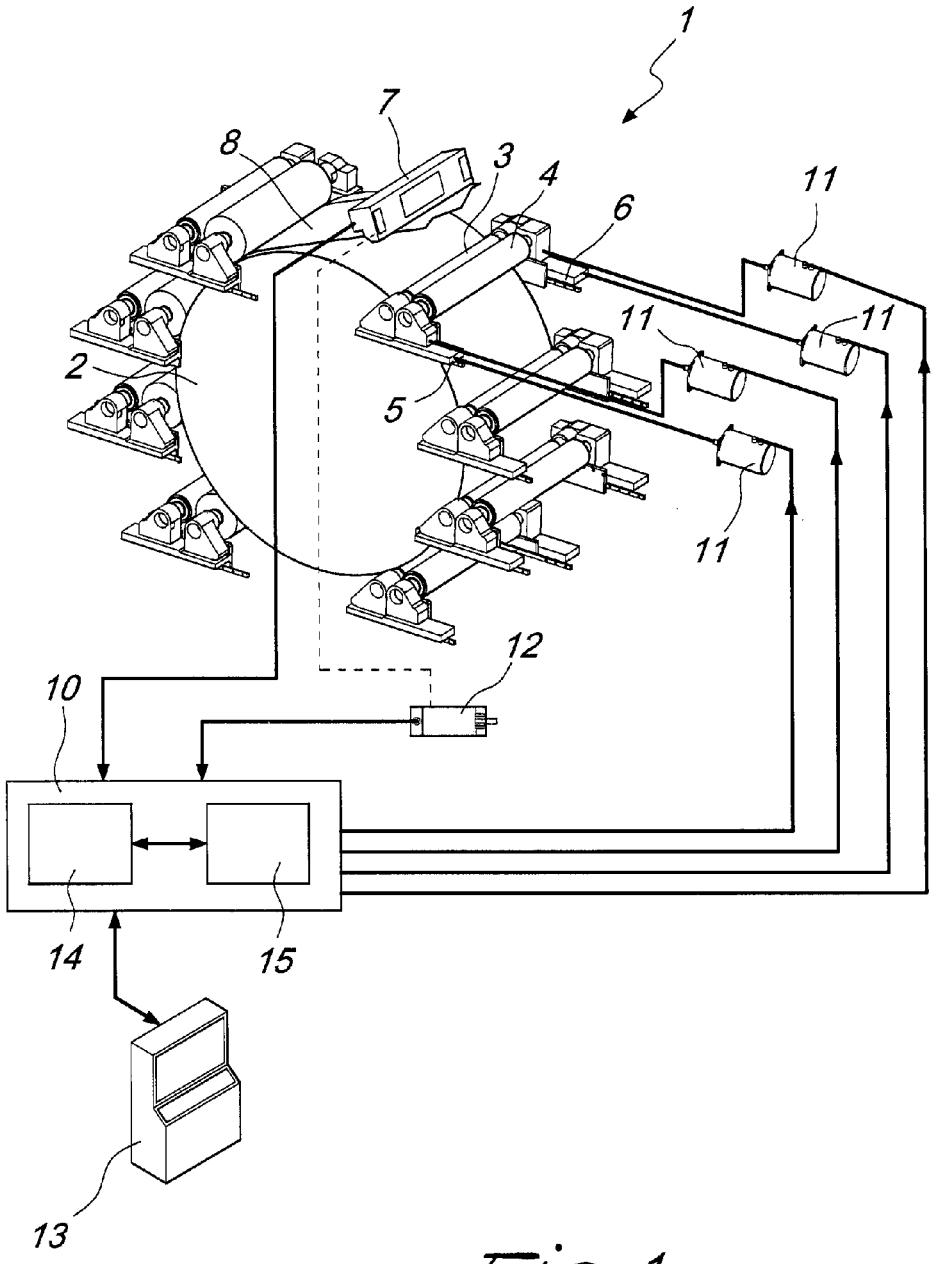
FIG. 1 is a schematic view of a flexographic printing machine with central drum to which the system according to the invention is applied.

With reference to the figures, a system according to the invention is applied to a printing machine and an assembly is generally designated by the reference numeral 1. In particular, the reference numeral 2 designates a central drum of the printing machine, whereas the reference numerals 3 and 4 designate respectively pairs of printing rollers and anilox rollers which are arranged around the central drum 2 and conveniently can move on pairs of guides 5 and 6 so as to cause the approach and/or spacing of the pairs of printing plate rollers 3 and anilox rollers 4 with respect to the central drum 2 of the flexographic printing machine.

Conventionally, the printing machine has an operator side, on which the printer works, and a transmission side, which is opposite to the operator side and on which the elements for transmission of the motion to the rollers of the machine are provided.

The system described above further comprises at least one reader 7, which is adapted to detect the contrast of the print on a printing material 8, which depends on the contact pressure that the printing plate roller 3 exerts on the printed material 8 wrapped around the central drum 2 and on the contact pressure that the anilox roller 4 exerts on the printing plate roller 3.

In particular, the reader 7 reads the entire print and measures the contrast of the print of the material 8 with respect to the material without print.

More precisely, the reader 7 is constituted by a scanning head whose size is equal to the width of the printing material 8 and which comprises internally a plurality of independent modules composed of a linear sensor, an acquisition lens, a lighting portion, an electronic control system. The signal in output provided by the reader 7 is an integration of the acquisition area of such reader.

The reader 7 is connected to a processing and control unit 10, which is adapted to control motors 11 for the positioning of the printing plate rollers 3 and anilox rollers 4 with respect to the central drum 2.

The reader 7 is synchronized with the printing performed by the printing rollers by means of a digital signal generated by a virtual printing plate 12.

The virtual printing plate 12 is a motor which rotates so as to be synchronized with the printing plate rollers and is provided with an encoder which generates a digital signal at each turn, which thus represents the turn of the printing plate rollers.

Finally, a control station 13 is used by the printer to control the operation of the system according to the invention.

The processing and control unit 10 provides for a processing section 14 and a control section 15.

The method for controlling the printing pressures according to the invention comprises the following steps:

Step 1

From the control station 13, the printer enters the data of the new job, such as for example the printing format, the type of material, the printing stations involved, the color printed by each station, and so forth.

Figure 2:
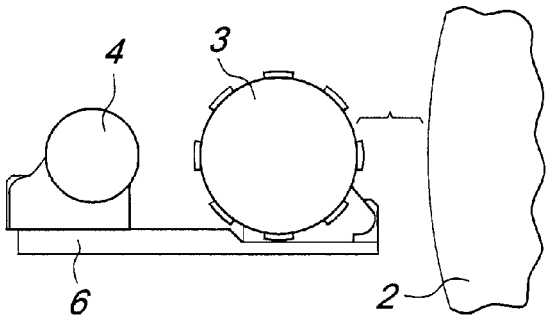
FIGS. 2-3, 4-5 and 6-7 are views of three operating steps for the positioning of the printing rollers with respect to the central drum.
Figure 3:
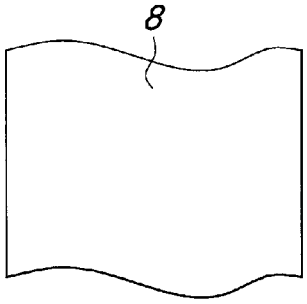

Step 2 (FIGS. 2 and 3)

The printer enables the process for controlling the printing pressures and commands the running of the printing machine. The printing machine accelerates to the speed at which the process for monitoring printing pressures occurs. The drum printing roller 2, the printing plate roller 3 and the anilox roller 4 are not in contact and do not print. The reader 7 performs self-calibration and measures the contrast of the material 8 without print.

Figure 6:
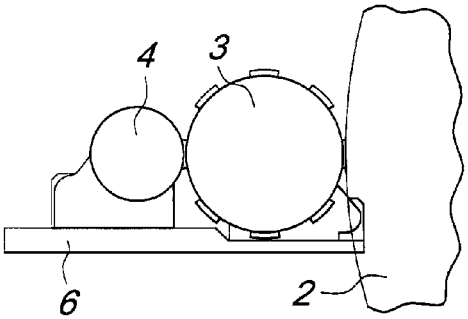
Figure 7:
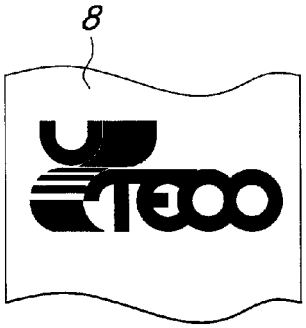

Step 3 (FIGS. 6 and 7)

The control section 15 commands the printing rollers of the first station, among the ones that have been inserted, to make mutual contact in order to print; i.e., it commands the printing plate roller 3 to make contact with the material wrapped around the drum 2 and the anilox roller 4 to make contact with the printing plate roller 3, according to a sequence of movements that are defined by a series of elevations calculated according to the dimensions of the rollers and of the printing systems.

The sequence first moves the anilox roller 4 so as to make contact with the printing plate roller 3 and ink it, then moves stepwise, or according to preset steps, the printing plate roller 3 from the position for not printing on the material (condition of minimum contrast) to the position of maximum printing pressure (condition of maximum contrast), until by an increase in printing pressure the contrast measured by the reader 7 no longer varies appreciably.

During the sequence, the reader 7 reads and measures the contrast of the material 8, after each movement performed by the printing plate roller 3 in order to move from the non-printing position to the position of maximum printing pressure. The movement of the printing plate roller 3 and the reading process by the reader 7 are synchronized by the virtual printing plate 12, for example every three turns of the virtual printing plate 12; the reading of the first turn is rejected, since in the first turn there is the transition from printing determined by the old position to printing determined by the new position; the reading of the second turn is rejected because in the second turn the new print stabilizes, and the reading of the third turn is considered valid.

Figure 8:
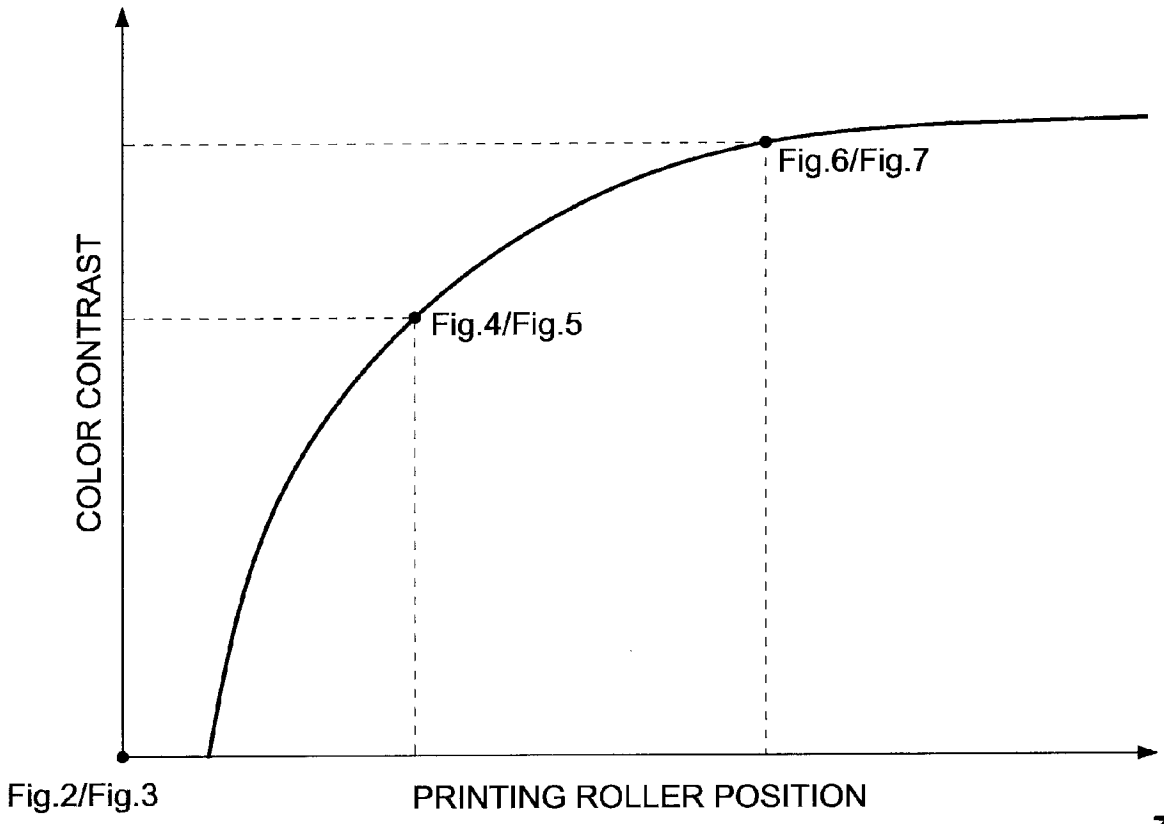
FIG. 8 is a chart which shows the contrast of the color in relation to the position of the printing roller.

During the sequence, the processing section 14 stores, for each movement of the printing plate roller 3, the position thereof and the contrast measured by the reader 7; the stored data can be represented as points of a Cartesian plane, where the X axis is the position of the printing plate roller 3 and the Y axis is the value of the contrast measured by the reader 7 (see the chart of FIG. 8).

Considering the chart of FIG. 8, the processing unit takes as a reference two points: the zero point, which is defined by the position of the printing roller and by the contrast measured by the reader 7, when no printing occurs; and the master point, which is defined by the position of the printing roller and by the contrast measured by the reader 7, when maximum printing pressure is applied.

In particular, the reader 7 reads every millimeter of the printed material, along its entire width, and for each millimeter of printed material it sends to the processing section 14 a value that is representative of the ink cover of the print on the operator side of the machine and a value that is representative of the ink cover of the print on the transmission side of the machine.

The processing section 14 stores the values of the ink cover for each millimeter of print, also known as "line cover", both for the operator side and for the transmission side.

Each printing station involved in printing performs this step, one at a time.

Figure 4:
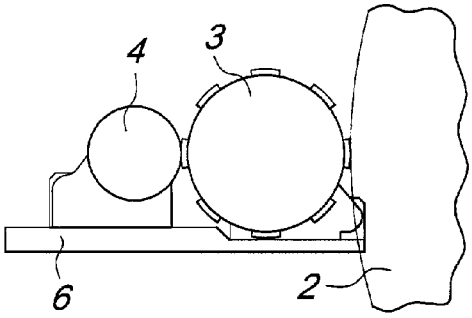
Figure 5:
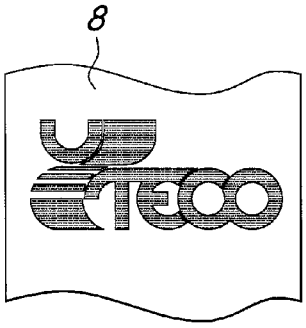

Step 4 (FIGS. 4 and 5)

After this step, which is constituted by the positioning of the printing rollers and by the measurement of the contrast of the print as the positions in contact vary and therefore as the printing pressures of the rollers vary, the processing section 14 analyzes and processes the acquired data, i.e., the zero point, the master point and the intermediate points defined by position and contrast, and calculates automatically the position and therefore the printing pressure of the printing plate roller 3 with respect to the central drum 2 in order to obtain the the desired print.

For each side of the print, the system takes as references the line cover of the master point of the operator side and the line cover of the master point on the transmission side.

The system according to the invention calculates the position of the printing plate roller 3 with respect to the central drum 2 for the transmission side and for the operator side in order to achieve optimum printing as the position that has the maximum possible pressure reduction with respect to that of the master point without however causing a significant reduction in cover on any of the lines detected at the master point.

As an alternative, it is possible to start from the zero point and detect the point when the degree of cover no longer increases.

Step 5

The control section 15 orders the printing plate roller 3 to move to the positions calculated by the processing section 14 in order to achieve the desired print.

The same method described above can also be performed to determine the correct printing pressures between the anilox roller 4 and the printing plate roller 3, by moving first the printing plate roller 3 to make contact with the material and then moving stepwise the anilox roller 4 from the position in which no contact occurs with the printing plate roller (condition of minimum contrast) to the position of maximum contact pressure (maximum contrast condition), until due to an increase of the printing pressure the contrast measured by the reader 7 no longer varies appreciably.

The method for controlling printing pressures according to the invention therefore provides for analysis and processing of the data and calculation of the new positions only once, at the end of step 3, and not with each new positioning, as occurs in the background art.

The advantage is a process which is simpler and faster and produces less printing waste.

For this purpose also, the reader 7 is arranged directly behind the print in output from the central drum 2 and before the drying oven.

Also for this purpose, it is convenient for the method for controlling printing pressures according to the invention and in particular the sequence of predefined movements of the printing rollers to begin from the point where the printing plate roller 3 skims the printing material 8 wrapped around the central drum 2 and the anilox roller 4 skims the printing plate roller 4; this point is known as "kiss point".

In practice it has been found that the system and the method according to the invention fully achieve the intended aim and objects.

The system and method thus conceived are susceptible of numerous modifications and variations, all of which are within the scope of the appended claims; all the details may further be replaced with other technically equivalent elements.

In practice, the materials used, as well as the contingent shapes and dimensions, may be any according to requirements and to the state of the art.

The disclosures in Italian Patent Application No. VR2010A000252 from which this application claims priority are incorporated herein by reference.

The invention claimed is:

1. A system for adjusting and monitoring pressures of printing rollers of a flexographic printing machine, comprising a central drum;

anilox rollers arranged around the central drum;

at least one reader, placed at the printing rollers of the flexographic printing machine, to detect the contrast of print on printing material wrapped around the central drum of the flexographic printing machine, the at least one reader constituted by a scanning head whose size is equal to the width of the printing material for reading the entire printing width and for measuring an amount of print on the printing material with respect to its background, the amount corresponding to the contrast; and a processing and control unit connected to the at least one reader to determine and control, as a function of the contrast detected by the at least one reader, a position of the printing rollers with respect to the central drum in order to achieve a desired print; and wherein the processing and control unit comprises a control section and a processing section to:

command performance of a sequence of stepwise movements of a printing roller with respect to the central drum or optionally of an anilox roller with respect to the printing roller, in order to make contact in printing at different printing pressures;

store for each movement of the printing roller data acquired regarding its position and the contrast measured by the at least one reader; and analyze and elaborate the acquired data and automatically calculate, the position and therefore the printing pressure of the printing roller with respect to the central drum in order to achieve the desired print.

2. The system according to claim 1, wherein the processing and control unit controls the movement of one of the printing rollers with respect to the central drum and the movement of another one of the printing rollers.

3. A method for controlling printing pressures for a flexographic printing machine having printing rollers by means of a system, the system comprising:

a central drum;

anilox rollers arranged around the central drum;

at least one reader, placed at the printing rollers of the flexographic printing machine, to detect the contrast of print on printing material wrapped around the central drum of the flexographic printing machine, the at least one reader constituted by a scanning head whose size is equal to the width of the printing material for reading the entire printing width and for measuring an amount of print on the printing material with respect to its background, the amount corresponding to the contrast; and a processing and control unit connected to the at least one reader to determine and control, as a function of the contrast detected by the at least one reader, a position of the printing rollers with respect to the central drum in order to achieve a desired print; and wherein the processing and control unit comprises a control section and a processing section to:

command performance of a sequence of stepwise movements of a printing roller with respect to the central drum or also of an anilox roller with respect to the printing roller, in order to make contact in printing at different printing pressures;

store for each movement of the printing roller data acquired regarding its position and the contrast measured by the at least one reader; and analyze and elaborate the acquired data and automatically calculate, the position and therefore the printing pressure of the printing roller with respect to the central drum in order to achieve the desired print; the method comprising the steps of:

1) entering from a control station data of a new job;

2) making the machine run at a speed at which the method for controlling printing pressures is performed, and measuring the contrast of the printing material without printing, by means of the at least one reader;

3) performing a sequence of stepwise movements of the printing roller with respect to the central drum or optionally of an anilox roller with respect to the printing roller, in order to make contact in printing at different printing pressures, and measuring a contrast of the print by means of the at least one reader and during performance of the sequence, storing for each movement of the printing roller data acquired regarding its position and the contrast measured by the at least one reader;

4) at the end of the sequence of movements and of the corresponding contrast measurements, determining, by means of the processing and control unit, analyzing and elaborating the acquired data and automatically calculating the position and therefore the printing pressure of the printing roller with respect to the central drum in order to achieve the desired print.

4. The method according to claim 3, wherein the step of moving the printing rollers with respect to the central drum is performed starting from a zero point or kiss point, assumed as the point at which the printing roller makes contact with the printing material or the anilox roller makes contact with the printing roller.

5. The method according to claim 4, wherein the movement of the printing roller with respect to the central drum and of the anilox roller with respect to the printing roller is performed with a sequence of movements with preset spacings, defined by elevations with respect to the zero point or kiss point.

6. The method according to claim 4, wherein the zero point or kiss point is the point where the printing roller begins to make contact with said printing material arranged on the central drum or the point where the anilox roller begins to make contact with the printing roller.

7. The method of claim 3 wherein the data for a new job comprises data selected from the group consisting of printing format, type of material to be printed, printing stations involved, color that is present on each station, or combinations thereof.

8. The system according to claim 1, further comprising a virtual printing plate, for synchronizing the movement of the printing rollers and the reading by the at least one reader, which is connected to the processing and control unit.

9. The system according to claim 8, wherein the virtual printing plate is constituted by a motor which rotates so as to be synchronized with the printing rollers and is provided with an encoder which generates a digital signal at each turn, which thus represents the turn of the printing rollers.

10. The system according to claim 9, wherein the virtual printing plate is synchronous with all the printing rollers of the flexographic printing machine.

* * * * *